US007140157B2

(12) United States Patent
Oliver et al.

(10) Patent No.: US 7,140,157 B2
(45) Date of Patent: Nov. 28, 2006

(54) FOUNDATION SYSTEM FOR BEAM OF MANUFACTURED HOME

(76) Inventors: James Oliver, P.O. Box 9, Hohenwald, TN (US) 38462; Evon L. Oliver, P.O. Box 9, Hohenwald, TN (US) 38462; Scott Oliver, P.O. Box 9, Hohenwald, TN (US) 38462; Daniel Oliver, P.O. Box 9, Hohenwald, TN (US) 38462; John Oliver, P.O. Box 9, Hohenwald, TN (US) 38462

( * ) Notice: Subject to any disclaimer, the term of this patent is extended or adjusted under 35 U.S.C. 154(b) by 0 days.

(21) Appl. No.: 10/164,166

(22) Filed: Jun. 4, 2002

(65) Prior Publication Data

US 2003/0221379 A1 Dec. 4, 2003

(51) Int. Cl.
*E02D 27/00* (2006.01)

(52) U.S. Cl. ..... 52/292

(58) Field of Classification Search ..... 52/292, 52/299, DIG. 11, DIG. 3, 167.1, 695, 741.15, 52/632; 248/121, 124.2, 125.9, 229.25, 229.2, 248/228.1, 228.6, 351, 352, 354.5, 354.6
See application file for complete search history.

(56) References Cited

U.S. PATENT DOCUMENTS

| | | | | |
|---|---|---|---|---|
| 347,489 | A | 8/1886 | Kenway | |
| 1,460,283 | A | 6/1923 | Shutsa | |
| 3,195,694 | A * | 7/1965 | Castro | 52/263 |
| 3,380,205 | A | 4/1968 | Ratchford | |
| 3,537,724 | A * | 11/1970 | Matthews | 280/763.1 |
| 3,724,151 | A | 4/1973 | Kaywood et al. | |
| 3,747,951 | A * | 7/1973 | Brown | 280/762 |
| 3,750,349 | A * | 8/1973 | Deike | 52/23 |
| 3,823,958 | A | 7/1974 | Trejbal | |
| 4,148,162 | A | 4/1979 | Goodrich | |
| 4,272,933 | A | 6/1981 | Lopes | |
| 4,348,843 | A * | 9/1982 | Cairns et al. | 52/167.1 |
| 4,417,426 | A * | 11/1983 | Meng | 52/126.7 |
| 4,562,673 | A * | 1/1986 | Barari | 52/167.1 |
| 4,866,797 | A | 9/1989 | Vollan | |
| 4,976,077 | A | 12/1990 | Tucker | |
| 5,359,821 | A | 11/1994 | Merriman | |
| 5,509,237 | A | 4/1996 | Coulter | |
| 5,697,191 | A | 12/1997 | MacKarvich | |
| 5,727,767 | A | 3/1998 | Jefrey | |
| 5,862,635 | A | 1/1999 | Linse | |
| 6,058,663 | A * | 5/2000 | MacKarvich | 52/167.3 |
| 6,119,412 | A | 9/2000 | Jackson | |
| 6,243,996 | B1 | 6/2001 | Oliver et al. | |
| 6,243,998 | B1 | 6/2001 | MacKarvich | |
| 6,381,907 | B1 * | 5/2002 | MacKarvich | 52/126.6 |
| 6,505,447 | B1 * | 1/2003 | Oliver et al. | 52/292 |
| 2003/0213197 | A1 * | 11/2003 | Oliver et al. | 52/299 |

* cited by examiner

*Primary Examiner*—A. Joseph Wujciak, III
(74) *Attorney, Agent, or Firm*—Calif Tervo; Palomar Patent

(57) ABSTRACT

A foundation system 50 for supporting a support beam 80 of a manufactured home and for preventing longitudinal movement of the beam; beam 80 having a longitudinal axis defining the longitudinal direction. Ground support pan 52 including blades 57 for insertion in the ground for preventing horizontal movement and a bracket 61 pivotably connecting lower ends 73 of a pair of rigid arms 70 substantially to the longitudinal middle 59 of pan 53 such that arms 70 form a V. Each upper end 76 of arms 70 is pivotably attached to a clamp 10 clamped to beam 80 such that the clamp 10 cannot move along beam 80.

17 Claims, 2 Drawing Sheets

FIG. 4
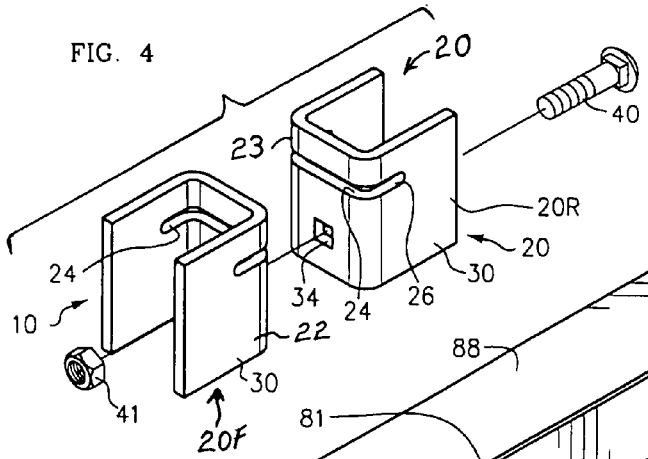
FIG. 1
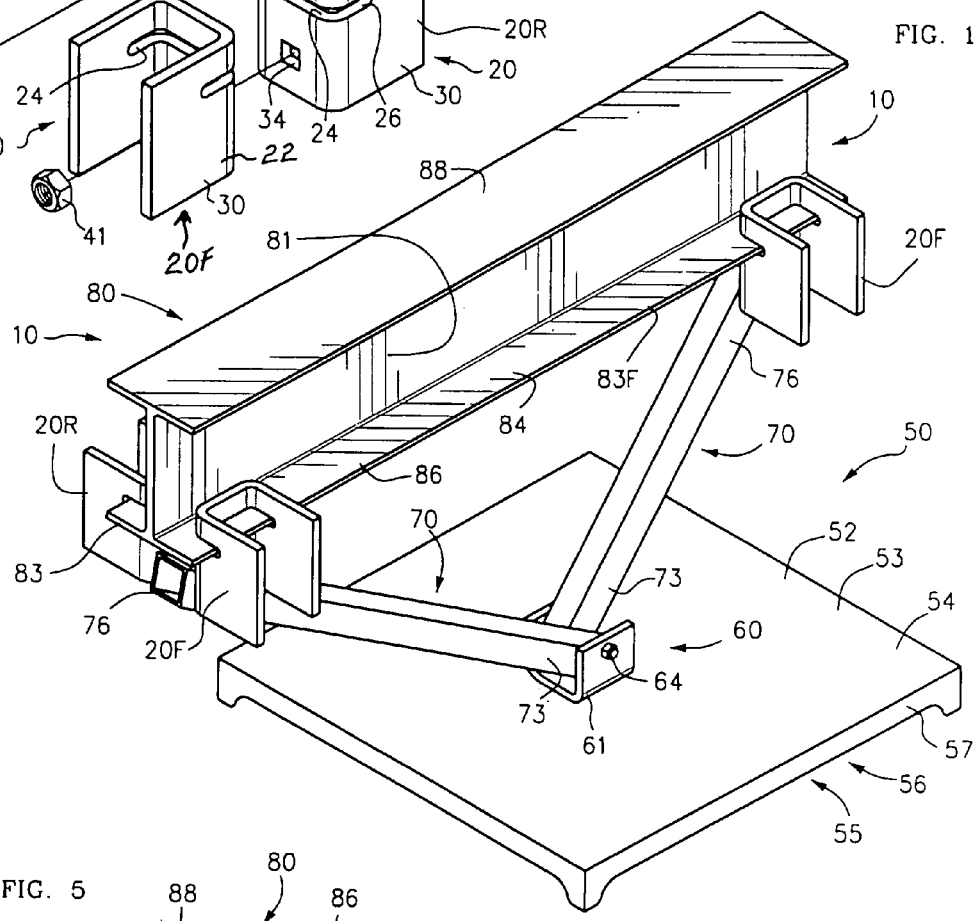
FIG. 5
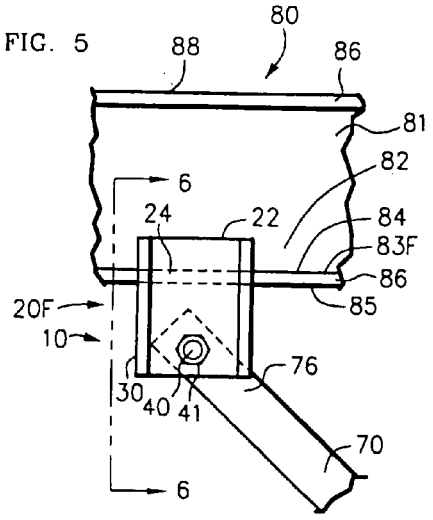
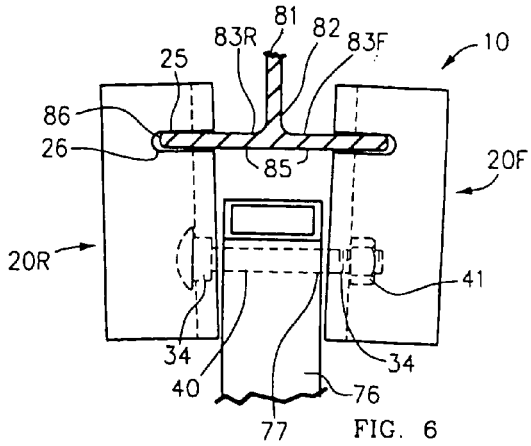
FIG. 6

FOUNDATION SYSTEM FOR BEAM OF MANUFACTURED HOME

FIELD OF THE INVENTION

This invention relates to a foundation system for supporting a beam of a manufactured home and preventing the beam from moving longitudinally, thus functioning both as a pier and as longitudinal braces.

BACKGROUND OF THE INVENTION

Manufactured homes, mobile homes or trailer coaches include long longitudinal support beams underneath. Typically, when the home or coach is installed, a plurality of vertical piers or jacks are placed under the beams to support them. Most piers or jacks require placement on a rigid ground pad so as to not sink into the ground from the loading. Conventional piers do not provide resistance to longitudinal forces or lateral forces that may be exerted on the coach such as by strong winds or earthquakes. Thus, additional stabilizing and anchoring systems have to be used.

It is desirable to have an improved foundation system that both supports the beam and provides longitudinal stability.

Since many foundation systems are required for a single manufactured home and since these systems have to be installed in the field and in a confined space under a manufactured home, it is desirable that they be simple and fast to install, preferably by a single person, not require complex tools and not require any alterations to the present beams, such as drilling, that could decrease the strength of the beams.

SUMMARY OF THE INVENTION

The invention is a foundation system for supporting a support beam of a manufactured home and for preventing longitudinal movement of the beam; the beam having a longitudinal axis defining the longitudinal direction. The foundation system generally comprises a pair of rigid arms, a ground support, and a pair of clamps. Each arm has a lower end and an upper end.

The ground support includes a pan for placement on the ground including blades for insertion in the ground for preventing horizontal movement and a bracket pivotably connecting the lower ends of the arms substantially to the longitudinal middle of the pan such that the arms form a V.

A clamp is associated with each arm. Each clamp includes a bolt for pivotably attaching the upper end of its associated arm and for clamping the clamp to the support beam such that the clamp cannot move along the beam.

The features and advantages of the invention will be readily understood when the detailed description thereof is read in conjunction with the accompanying drawings wherein like reference numerals refer to like parts throughout.

BRIEF DESCRIPTION OF THE DRAWINGS

FIG. 1 is a perspective view of an exemplary embodiment of the foundation system of the invention attached to a support beam of a manufactured home.

FIG. 4 is an exploded perspective view of a clamp for attaching the foundation system to a support beam of a manufactured home.

FIG. 5 is a partial side elevation view of the beam connection.

FIG. 6 is an end view of the beam connection taken on line 6—6 of FIG. 5.

DETAILED DESCRIPTION OF THE INVENTION

Figure 2:
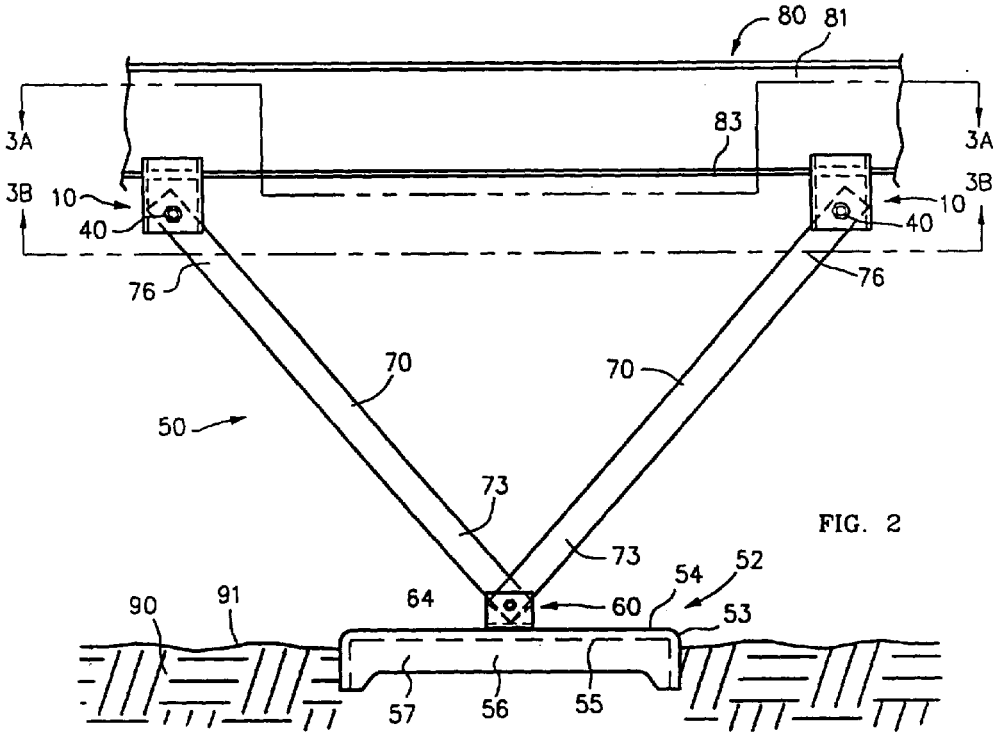
FIG. 2 is a front elevation view of FIG. 1.
Figure 3A:
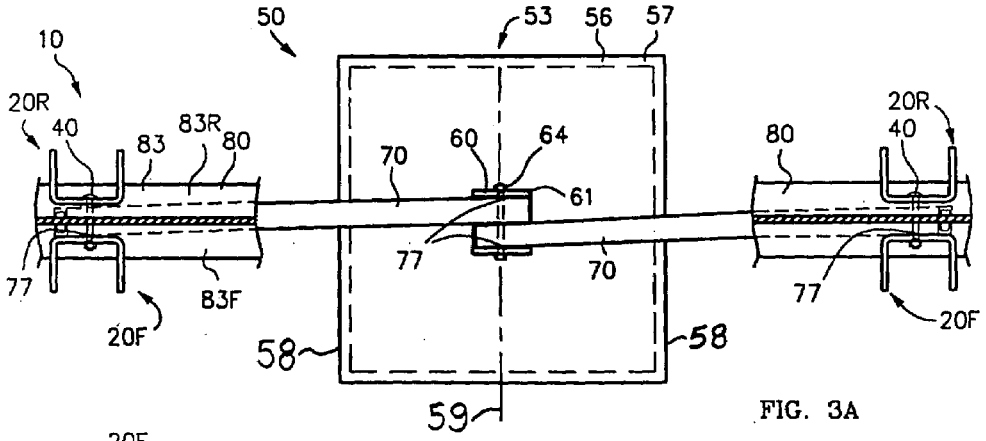
FIG. 3A is a sectional view taken on line 3A—3A of FIG. 2.
Figure 3B:
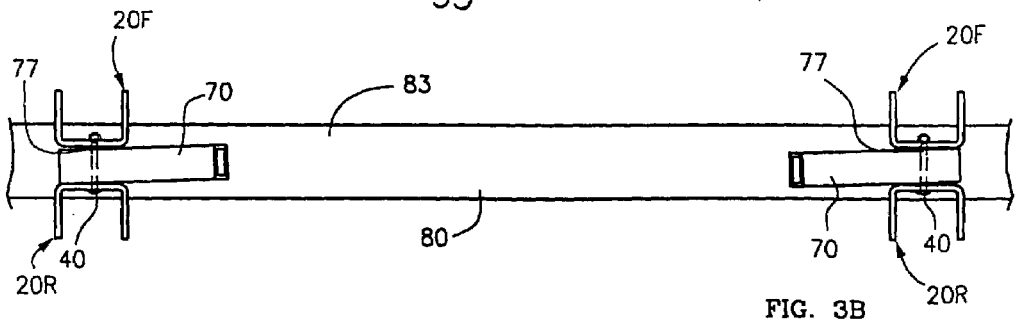
FIG. 3B is a sectional view taken on line 3B—3B of FIG. 2.

With reference now to the drawings, FIG. 1 is a perspective view of an exemplary embodiment of the foundation system 50 of the invention attached to a support beam 80 of a manufactured home. FIG. 2 is a front elevation view of FIG. 1. FIG. 3A is a sectional view taken on line 3A—3A of FIG. 2. FIG. 3B is a sectional view taken on line 3B—3B of FIG. 2.

Foundation system 50 includes a ground support means 52, a pair of rigid arms 70 and means, such as a pair of clamps 10, each clamp 10 for attaching an arm 70 to beam 80.

Each arm 70 has an upper end 76 and a lower end 73. Each upper end 76 and lower end 73 includes a bore 77 for receiving a fastener, 40, 64 respectively, for pivotable connection. Arms 70 may be of any suitably strong material, such as of one and one-half inch square steel tube.

Ground support means 52 prevents downward and horizontal movement of lower ends 73 of arms 70 and retains lower ends 73 of arms 70 in a fixed, but pivotable, position. Ground support means 52, includes a support, such as a cement footing or ground pan 53, shown, and arm connecting means 60. Ground pan 53 has a top surface 54, a bottom 55, and ground blade means 56, such as insertion perimeter 57, that is a perimeter downward extending wall. Ground pan 53 is placed on the ground and insertion perimeter 57 is pressed into the ground. When pan 53 is weighted, the side-facing wall of insertion perimeter 57 prevents horizontal movement of pan 53. The area of bottom 55 of pan 53 bears against surface 91 of soil 90 and prevents downward movement. Ground pan 53 is made of strong material such as of steel.

Arm connecting means 60 includes a bracket, such as U-bracket 61, and bolt 64. U-bracket 61 is connected to ground pan 53 by any suitable means, such as welding, and includes bores for receiving a fastener, such as bolt 64. Bolt 64 is disposed through bores 77 for side by side lower ends 73 of arms 70 and pivotably connects lower ends 73 of arms 70 to bracket 61. Bolt 64 is located substantially in the longitudinal middle of pan 53.

FIG. 4 is an exploded perspective view of a clamp 10 for attaching foundation system 50 to support beam 80 of a manufactured home. FIG. 5 is a partial side elevation view of the beam connection. FIG. 6 is an end view of the beam connection taken on line 6—6 of FIG. 5.

Support beam 80 has a vertical web 81 and a bottom end 82 having a lateral flange 83 including a front flange 83F and a rear flange 83R. Each flange 83F, 83R has a top 84, a bottom 85, and a free end 86. Beam 80 top 88 supports a manufactured home.

Clamp 10 includes a pair of flange mount members 20, such as front member 20F and rear member 20R, and connecting means, such as an adjustable tension member, such as carriage bolt 40 and nut 41. Each flange mount member 20F, 20R includes a top 22, a medial side 23 facing web 81, and a lower portion 30. Medial side 23 includes a channel 24 adapted for receiving a flange, 83F or 83R. Channel 24 includes a top surface 25 and a bottom surface 26. Lower portion 30 is lower than channel 24 and, therefore, below flange 83F, 83R when member 20 is mounted thereon. Lower end 30 includes bores 34 for receiving bolt 40. Preferably, at least one of these bores 34 is adapted, such as by being square, to prevent the head of bolt 40 from turning. In the exemplary embodiment, members 20 are made of U-shaped steel.

Clamp 10 is attached to beam 80 by mounting channel 24 of front member 20F on front flange 83F and mounting channel 24 of rear member 20R on rear flange 83R opposite front member 20F. Top end 76 of arm 70 is placed between lower end 30 of mounted members 20F, 2OR and carriage bolt 40 is inserted through bores 34 and 77 to pivotably connect arm 70 to clamp 10.

Bolt 40 is tightened, such as by turning nut 41, and urges lower portions 30 of mounted members 20F, 20R together as seen in FIG. 4 such that at least one of mounted channels 24 binds on its received flange 83F, 83R and holds clamp 10 in place on beam 80.

Preferably, channels 24 have a depth such that mounted members 20F, 20R are sufficiently separated such that there is more than enough room for upper end 76 of arm 70 to fit therebetween and such that tightening bolt 40 pulls lower ends 30 together and tilts them so as to bind. Channels 24 have a height such that forcing lower ends 30 outward or inward so as to tilt members 20, such as by tightening bolt 40, binds channels 24 on flange 83 such that clamp 10 cannot move. In this manner, tightening a single bolt 40 clamps clamp 10 in a given location on beam 80. Clamp 10 can be used to support beam 80 and prevent beam 80 from longitudinal movement.

To use foundation system 50, a manufactured home is first supported by any suitable temporary means, such as piers or jacks, well-known in the art. Pan 53 is placed on surface 91 of soil 90 ground under support beam 80 of a manufactured home and blade or insertion perimeter 57 is pressed into soil 90. Lower ends 73 of arms 70 are pivotably attached, such as by a single bolt 64, to pan 53. Each clamp 10 is pivotably attached to upper end 76 of its respective arm 70 and to lower flange 83 of beam 80, each such as by a single bolt 40. The temporary supports can now be removed.

Arms 70 pivot so as to attach anywhere along beam 80. The spacing between beam 80 and ground surface 91 is not critical as it only changes the angle of the "V" of arms 70. Therefore, arms 70 do not need to be adjustable in length. Arms 70 of a single length may likely be useable for supporting a given home regardless of irregularities in ground level. Preferably, arms 70 are raised an angle of 40 to 60 degrees. In general, the smaller the angle, the greater the prevention of longitudinal movement of beam 80.

It has been found that pivotably attaching arms 70 to the longitudinal middle of pan 53 prevents pan 53 from lifting and causing failure if beam 80 attempts to move longitudinally. Beam 80 is both supported and prevented from longitudinal movement by tightening just three bolts. No drilling is required.

From the foregoing description, it is seen that the foundation system of the invention provides an extremely simple, efficient, and reliable manner for supporting a support beam of a manufactured home and for preventing longitudinal movement of the beam.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A foundation system for supporting a support beam of a manufactured home and for preventing longitudinal movement of the beam; the beam having a longitudinal axis defining the longitudinal direction and a bottom end including a lateral flange including a front flange and a rear flange; each flange having a top, a bottom, and a free end, said foundation system comprising:

a pair of rigid arms; each arm including:
- a lower end; and
- an upper end;

ground support means for supporting the beam including:
- a support for preventing downward and longitudinal movement of the beam; and
- arm connecting means for pivotably connecting said lower ends of said arms to said ground support means; said arm connecting means comprising:
  - a single fastener about which both said lower ends of said arms freely pivot;

a pair of clamps; each clamp associated with a respective one of said upper ends of said arms; each clamp including:
- attachment means for pivotly attaching said clamp to said upper end of said clamp's associated said arm; and
- clamping means for clamping said clamp to the front and rear flanges of the lateral flange of the bottom end of the support beam such that said clamp cannot move along the beam; said lower ends of said arms connected to said ground support means so as to be freely pivoting such that, responsive to supporting the beam, each said clamp exerts an upward force supporting the beam and a resultant longitudinal force on the beam.

2. The foundation system of claim 1 wherein:

said single fastener of said arm connecting means is a single bolt.

3. The foundation system of claim 1 wherein:

said attachment means and said clamping means of each clamp jointly comprise only a single fastener such that only three fasteners are required to pivotly connect said arms to said ground support means, pivotly attach said arms to said clamps and clamp said clamps on the beam.

4. In combination:

a horizontal support beam for a manufactured home; said beam having a longitudinal axis defining the longitudinal direction; said beam including:

a bottom end including:
- a lateral flange including:
  - a front flange; and
  - a rear flange; each flange having a top, a bottom, and a free end; and a foundation system supporting said support beam and for preventing longitudinal movement of said beam; said foundation system comprising
- a pair of rigid arms; each arm including:
  - a lower end; and
  - an upper end;
- ground support means for supporting said beam including:

a support for preventing downward and longitudinal movement of the beam; and arm connecting means pivotably connecting said lower ends of said arms to said ground support means; said arm connecting means comprising:

a single fastener about which both said lower ends of said arms freely pivot;

a pair of clamps; each clamp associated with a respective one of said upper ends of said arms; each clamp including:

attachment means for pivotly attaching said clamp to said upper end of said clamp's associated said arm; and clamping means for clamping said clamp to said front and rear flanges of said lateral flange of said bottom end of said support beam such that said clamp cannot move along said beam; said lower ends of said arms connected to said ground support means so as to be freely pivoting such that, responsive to supporting said beam, each said clamp exerts an upward force supporting said beam and a resultant longitudinal force on said beam.

5. The combination of claim 4 wherein:

said single fastener of said arm connection means comprises a single bolt.

6. The combination of claim 5 wherein:

said attachment means and said clamping means of each clamp jointly comprise a single fastener such that only three fasteners are required to pivotly connect said arms to said ground support means, pivotly attach said arms to said clamps and clamp said clamps on said beam.

7. In combination:

a horizontal support beam for a manufactured home; said beam having a longitudinal axis defining the longitudinal direction; said beam including:

a bottom end including:

a lateral flange including:

a front flange; and a rear flange; each flange having a top, a bottom, and a free end; and a foundation system supporting said support beam and for preventing longitudinal movement of said beam; said foundation system comprising a pair of rigid arms; each arm including:

a lower end; and an upper end;

ground support means for supporting said beam including:

a support for preventing downward and longitudinal movement of the beam; and arm connecting means pivotably connecting said lower ends of said arms to said ground support means;

a pair of clamps; each clamp associated with a respective one of said upper ends of said arms; each clamp including:

attachment means for pivotly attaching said clamp to said upper end of said clamp's associated said arm; and clamping means for clamping said clamp to said front and rear flanges of said lateral flange of said bottom end of said support beam such that said clamp cannot move along said beam; said lower ends of said arms connected to said ground support means so as to be freely pivoting such that, responsive to supporting said beam, each said clamp exerts an upward force supporting said beam and a resultant longitudinal force on said beam; wherein:

each said clamp includes:

a front member including:

a top;

a medial side facing said beam including:

a channel adapted for receiving said front flange of said beam including:

a top surface facing said top of said front flange; and a bottom surface facing said bottom of said front flange; and a lower portion lower than said channel;

a rear member including:

atop;

a medial side facing said beam including:

a channel adapted for receiving said rear flange of said beam including:

a top surface facing said top of said rear flange; and a bottom surface facing said bottom of said rear flange; and a lower portion lower than said channel; and said clamping means connects said lower portions of said clamp members for urging them together such that at least one said channel binds on said channel's received said flange and holds said clamp in place on said beam.

8. A method of supporting a support beam of a manufactured home and for preventing longitudinal movement of the beam; the beam having a longitudinal axis defining the longitudinal direction; the beam including: a bottom end including: a lateral flange including: a front flange; and a rear flange; each flange having a top, a bottom, and a free end; the method comprising:

supporting the beam with temporary support means for temporarily supporting the beam;

providing a pair of rigid arms; each arm including: a lower end; and an upper end;

providing a ground support means for supporting the beam including a support for preventing downward and longitudinal movement of the beam and arm connecting means for pivotably connecting the lower ends of the arms to the support placing the ground support means on the ground under the beam;

pivotably connecting the lower ends of the arms with the arm connecting means to the support by passing a single fastener through both lower ends of the arms such that the arms freely pivot;

providing a pair of clamps; each clamp associated with a respective one of the arms;

pivotably attaching the upper end of each arm to each arm's associated clamp;

clamping the clamps to the support beam supported by the temporary support means such that the clamps cannot move along the beam; and unsupporting the beam with the temporary support means such that each clamp exerts an upward force supporting the beam and a resultant longitudinal force on the beam.

9. The method of claim 8 wherein the steps of clamping each clamp to the beam and pivotably attaching the upper end of each arm to each arm's associated clamp includes:

tightening only a single fastener such that only three fasteners are required to pivotly connect the arms to the ground support means, pivotly attach the arms to the clamps and clamp the clamps on the beam.

10. A method of supporting a support beam of a manufactured home and for preventing longitudinal movement of the beam; the beam having a longitudinal axis defining the longitudinal direction; the beam including: a bottom end including: a lateral flange including: a front flange; and a rear flange; each flange having a top, a bottom, and a free end; the method comprising:

supporting the beam with temporary support means for temporarily supporting the beam;

providing a pair of rigid arms; each arm including: a lower end; and an upper end;

providing a ground support means for supporting the beam including a support for preventing downward and longitudinal movement of the beam and arm connecting means for pivotably connecting the lower ends of the arms to the support;

placing the support on the ground under the beam;

pivotably connecting the lower ends of the arms with the arm connecting means to the support such that the arms freely pivot;

providing a pair of clamps; each clamp associated with a respective one of the arms;

pivotably attaching the upper end of each arm to each arm's associated clamp and clamping the clamps to the support beam supported by the temporary support means such that the clamps cannot move along the beam by tightening only a single fastener such that only two fasteners are required to pivotly attach the arms to the clamps and clamp the clamps on the beam; and unsupporting the beam with the temporary support means such that each clamp exerts an upward force supporting the beam and a resultant longitudinal force on the beam.

11. The method of claim 10 wherein the step of pivotably connecting the lower ends of the arms with the arm connecting means the ground support means includes:

passing a single bolt through both lower ends of the arms.

12. A foundation system for supporting a support beam of a manufactured home and for preventing longitudinal movement of the beam; the beam having a longitudinal axis defining the longitudinal direction and a bottom end including a lateral flange including a front flange and a rear flange; each flange having a top, a bottom, and a free end, said foundation system comprising:

a pair of rigid arms; each arm including:

a lower end; and an upper end;

ground support means for supporting the beam including:

a support for preventing downward and longitudinal movement of the beam; and arm connecting means for pivotably connecting said lower ends of said arms to said support;

a pair of clamps; each clamp associated with a respective one of said upper ends of said arms; each clamp including:

attachment means for pivotly attaching said clamp to said upper end of said clamp's associated said arm; and clamping means for clamping said clamp to the front and rear flanges of the lateral flange of the bottom end of the support beam such that said clamp cannot move along the beam; said lower ends of said arms connected to said support so as to be freely pivoting such that, responsive to supporting the beam, each said clamp exerts an upward force supporting the beam and a resultant longitudinal force on the beam; wherein: said attachment means and said clamping means of each clamp jointly comprise only a single fastener such that only two fasteners are required to attach said upper ends of said arms to said clamps and clamp said clamps on the beam.

13. In combination:

a horizontal support beam for a manufactured home; said beam having a longitudinal axis defining the longitudinal direction; said beam including:

a bottom end including:

a lateral flange including:

a front flange; and a rear flange; each flange having a top, a bottom, and a free end; and a foundation system supporting said support beam and for preventing longitudinal movement of said beam; said foundation system comprising a pair of rigid arms; each arm including:

a lower end; and an upper end;

ground support means for supporting the beam including:

a support for preventing downward and longitudinal movement of the beam; and arm connecting means pivotably connecting said lower ends of said arms to said support;

a pair of clamps; each clamp associated with a respective one of said upper ends of said arms; each clamp including:

attachment means for pivotly attaching said clamp to said upper end of said clamp's associated said arm; and clamping means for clamping said clamp to said front and rear flanges of said lateral flange of said bottom end of said support beam such that said clamp cannot move along said beam; said lower ends of said arms connected to said support so as to be freely pivoting such that, responsive to supporting said beam, each said clamp exerts an upward force supporting said beam and a resultant longitudinal force on said beam wherein: said attachment means and said clamping means of each clamp jointly comprise only a single fastener such that only two fasteners are required to pivotly attach said upper ends of said arms to said clamps and clamp said clamps on said beam.

14. A method of supporting a support beam of a manufactured home and for preventing longitudinal movement of the beam; the beam having a longitudinal axis defining the longitudinal direction; the beam including: a bottom end including: a lateral flange including: a front flange; and a rear flange; each flange having a top, a bottom, and a free end; the method comprising:

supporting the beam with temporary support means for temporarily supporting the beam;

providing a pair of rigid arms; each arm including: a lower end; and an upper end;

providing a ground support means for supporting the beam including a support for preventing downward and longitudinal movement of the beam and arm connecting means for pivotably connecting the lower ends of the arms to the ground support means;

placing the support on the ground under the beam;

pivotably connecting the lower ends of the arms with the arm connecting means to the support such that the arms freely pivot;

providing a pair of clamps; each clamp associated with a respective one of the upper ends of the arms;

pivotably attaching the upper end of each arm to each arm's associated clamp;

clamping the clamps to the support beam supported by the temporary support means such that the clamps cannot move along the beam; and unsupporting the beam with the temporary support means such that each clamp exerts an upward force supporting the beam and a resultant longitudinal force on the beam; wherein the step of providing a pair of clamps includes providing clamps each including:

a front member including:

a top;

a medial side for facing the beam including:

a channel adapted for receiving the front flange of said beam including:

a top surface facing the top of the front flange; and a bottom surface facing the bottom of the front flange; and a lower portion lower than the channel;

a rear member including:

a top;

a medial side for facing the beam including:

a channel adapted for receiving the rear flange of said beam including:

a top surface facing the top of the rear flange; and a bottom surface facing the bottom of the rear flange; and a lower portion lower than the channel; and said clamping means for connecting the lower portions of the clamp members for urging them together such that at least one channel binds on the channel's received flange and holds the clamp in place on the beam; wherein the step of clamping each clamp to the support beam includes the steps of:

placing the channel of the front member around the front flange;

placing the channel of the rear member around the rear flange; and urging the lower portions together with the clamping means such that at least one channel binds on the channel's received flange and holds the clamp in place on the beam.

15. A foundation system for supporting a support beam of a manufactured home and for preventing longitudinal movement of the beam; the beam having a longitudinal axis defining the longitudinal direction and a bottom end including a lateral flange including a front flange and a rear flange; each flange having a top, a bottom, and a free end, said foundation system comprising:

a pair of rigid arms; each arm including:

a lower end; and an upper end;

ground support means for supporting the beam including:

a support for preventing downward and longitudinal movement of the beam including:

a pan having a longitudinal middle; said pan including:

a bottom for bearing against the ground for preventing downward movement; and blade means for insertion in the ground for preventing longitudinal movement; and single arm connecting means for pivotably connecting said lower ends of said arms to said longitudinal middle of said pan; said single arm connecting means comprising:

a single fastener about which said lower ends of said arms freely pivot;

a pair of clamps; each clamp associated with a respective one of said upper ends of said arms; each clamp including:

attachment means for pivotly attaching said clamp to said upper end of said clamp's associated said arm; and clamping means for clamping said clamp to the front and rear flanges of the lateral flange of the bottom end of the support beam such that said clamp cannot move along the beam; said lower ends of said arms connected to said longitudinal middle of said pan so as to be freely pivoting such that, responsive to supporting the beam, each said clamp exerts an upward force supporting the beam and a resultant longitudinal force on the beam.

16. The foundation system of claim 15 wherein:

said attachment means and said clamping means of each clamp jointly comprise only a single fastener such that only three fasteners are required to pivotly connect said arms to said pan, pivotly attach said arms to said clamps and clamp said clamps on the beam.

17. A foundation system for supporting a support beam of a manufactured home and for preventing longitudinal movement of the beam; the beam having a longitudinal axis defining the longitudinal direction and a bottom end including a lateral flange including a front flange and a rear flange; each flange having a top, a bottom, and a free end, said foundation system comprising:

a pair of rigid arms; each arm including:

a lower end; and an upper end;

ground support means for supporting the beam including:

a support for preventing downward and longitudinal movement of the beam; and arm connecting means for pivotably connecting said lower ends of said arms to said support;

a pair of clamps; each clamp associated with a respective one of said upper ends of said arms; each clamp including:

attachment means for pivotly attaching said clamp to said upper end of said clamp's associated said arm; and clamping means for clamping said clamp to the front and rear flanges of the lateral flange of the bottom end of the support beam such that said clamp cannot move along the beam; said lower ends of said arms connected to said support as to be freely pivoting such that, responsive to supporting the beam, each said clamp exerts an upward force supporting the beam and a resultant longitudinal force on the beam; wherein:

each said clamp includes:

a front member including:

a top;

a medial side facing said beam including:

a channel adapted for receiving said front flange of said beam including:

a top surface facing said top of said front flange; and a bottom surface facing said bottom of said front flange; and a lower portion lower than said channel;

a rear member including:

atop;

a medial side facing said beam including:

a channel adapted for receiving said rear flange of said beam including:

a top surface facing said top of said rear flange; and a bottom surface facing said bottom of said rear flange; and a lower portion lower than said channel; and said clamping means connects said lower portions of said clamp members for urging them together such that at least one said channel binds on said channel's received said flange and holds said clamp in place on said beam.

* * * * *